US005121814A

United States Patent [19]

Southern

[11] Patent Number: 5,121,814

[45] Date of Patent: Jun. 16, 1992

[54] ADJUSTABLE LADDER STAND-OFF BRACE FOR CORNER WALLS

[76] Inventor: Don L. Southern, 1918 Euharlee Rd., Kingston, Ga. 30145-2502

[21] Appl. No.: 630,280

[22] Filed: Dec. 19, 1990

Related U.S. Application Data

[63] Continuation-in-part of Ser. No. 505,838, Apr. 6, 1990.

[51] Int. Cl.[5] ..... E06C 7/48

[52] U.S. Cl. ..... 182/214; 182/111; 248/210

[58] Field of Search ..... 182/214, 107, 206, 111; 248/210

[56] References Cited

U.S. PATENT DOCUMENTS

| | | | |
|---|---|---|---|
| 1,570,576 | 1/1926 | Rivitz | 182/111 |
| 2,327,317 | 8/1943 | Randall | 182/214 |
| 2,597,902 | 5/1952 | Roketa | 182/214 |
| 3,288,249 | 11/1966 | Gibson | 182/214 |
| 3,693,756 | 9/1972 | Walker et al. | 182/129 |
| 3,708,080 | 1/1973 | Schlei | 182/214 |
| 3,780,828 | 12/1973 | Overturf | 182/111 |
| 4,369,860 | 1/1983 | Beane | 182/214 |
| 4,440,263 | 3/1984 | Smith | 182/121 |
| 4,502,566 | 3/1985 | Wing | 182/214 |
| 5,010,979 | 4/1991 | Shreve, III | 182/214 |

*Primary Examiner*—Reinaldo P. Machado

[57] ABSTRACT

A stand-off brace for attachment to the top end of a ladder maintains the top end of the ladder away from the work surface against which it would ordinarily rest. The brace has a general U-shape wherein the legs are reversible to vary the distance between the ladder and the work surface. The distance between the legs is also adjustable so that the brace spans the work surface. The legs are fitted with resilient ads for contacting the work surface without damage. Corner adapters are connected to the legs and the pads are pivotally attached to the adapters to maintain flush contact with the walls of a corner or a curved surface. The corner adapters have an angular offset to maintain flush contact with the ladder positioned at the recommended working angle.

19 Claims, 2 Drawing Sheets

ADJUSTABLE LADDER STAND-OFF BRACE FOR CORNER WALLS

CROSS REFERENCE TO RELATED APPLICATIONS

This application is a continuation-in-part of application Ser. No. 07/505,838 filed Apr. 6, 1990, pending.

TECHNICAL FIELD

This invention generally relates to ladders, and, more particularly to ladder attachments for positioning the ladder away from the work surface, increasing the effective width of the ladder to prevent the ladder from resting on doors or windows, and positioning a ladder on corner walls.

BACKGROUND OF THE INVENTION

A ladder is used to help people reach places they would not ordinarily be able to reach. Ladders are often used to climb onto roofs of buildings and are used when washing window or painting. In normal use, the bottom portion of the ladder rests on the ground or other surface, and the top end of the ladder typically leans against the building or work surface. The ladder is oriented at an angle which makes it easy for a user to climb up and down the ladder, and also aids in keeping the ladder from slipping. The angle recommended by the Occupational Health and Safety Administration ("OSHA") is seventy five and one-half degrees whereby the ladder slants from the vertical toward to work surface.

There are several attachments intended to stabilize a ladder to reduce the possibility of injury. Other attachments span windows and doors to make working around windows and doors easier. Such attachments, while facilitating work near windows, does nothing to facilitate work at corner. In fact, the attachments that span windows actually position a worker farther from the corner than the ladder alone. Accordingly, it will be appreciated that it would be highly desirable to have a ladder attachment that spans a corner to position a worker at the corner.

Ordinary ladders without stabilizers can be positioned adjacent a corner, but there will be great lateral instability whenever a worker reaches or leans outside the rails of the ladder. The ladder can be positioned on the corner with the rungs resting on the corner to support the ladder which is obviously unsafe. An attempt to use window spanning attachments on a corner will fail because the ladder moves toward the corner under load coming to rest on the rungs.

In addition, the motion of the attachment against the wall may damage the wall because of the small area of contact the attachment makes with the wall. The contact area is small because an attachment made for flat contact with a straight wall will contact the sides of the corner at an angle instead of directly. Accordingly, it will be appreciated that it would be highly desirable to have a ladder attachment that spans a corner and holds the rungs off the corner without damaging the structure.

SUMMARY OF THE INVENTION

The present invention is directed to overcoming one or more of the problems set forth above. Briefly summarized, according to one aspect of the present invention, an attachment for a ladder having first and second siderails, comprises an elongated bar having first and second end portions and a middle portion extending between the end portions with the first and second end portions angularly extending from the middle portion. A first corner adapter pivotally connects a first resilient pad to the first end portion of the bar. A second corner adapter pivotally connects a second resilient pad to the second end portion of the bar.

It is an object of the present invention to provide ladder which can be positioned on a corner wall.

It is also an object of the present invention to provide ladder which can be positioned on a curved or irregular wall.

Another object of the invention is to provide a non-slip gripping portion for a ladder that grips the work surface without damaging the work surface.

Another object of the present invention to provide ladder which can be positioned on the walls of a sharp or curved corner with the gripping surfaces flush against the walls. A feature of the invention is corner adapters connecting resilient pad assemblies that pivot to fit flush against corner walls. Another feature is the corner adapters have angular offsets that keep the ladder at the recommended angle while the pads are flush against the corner walls. An advantage of the present invention is that the ladder can span windows, doors and fit around corner walls while maintaining the recommended safety angle without damaging the wall.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
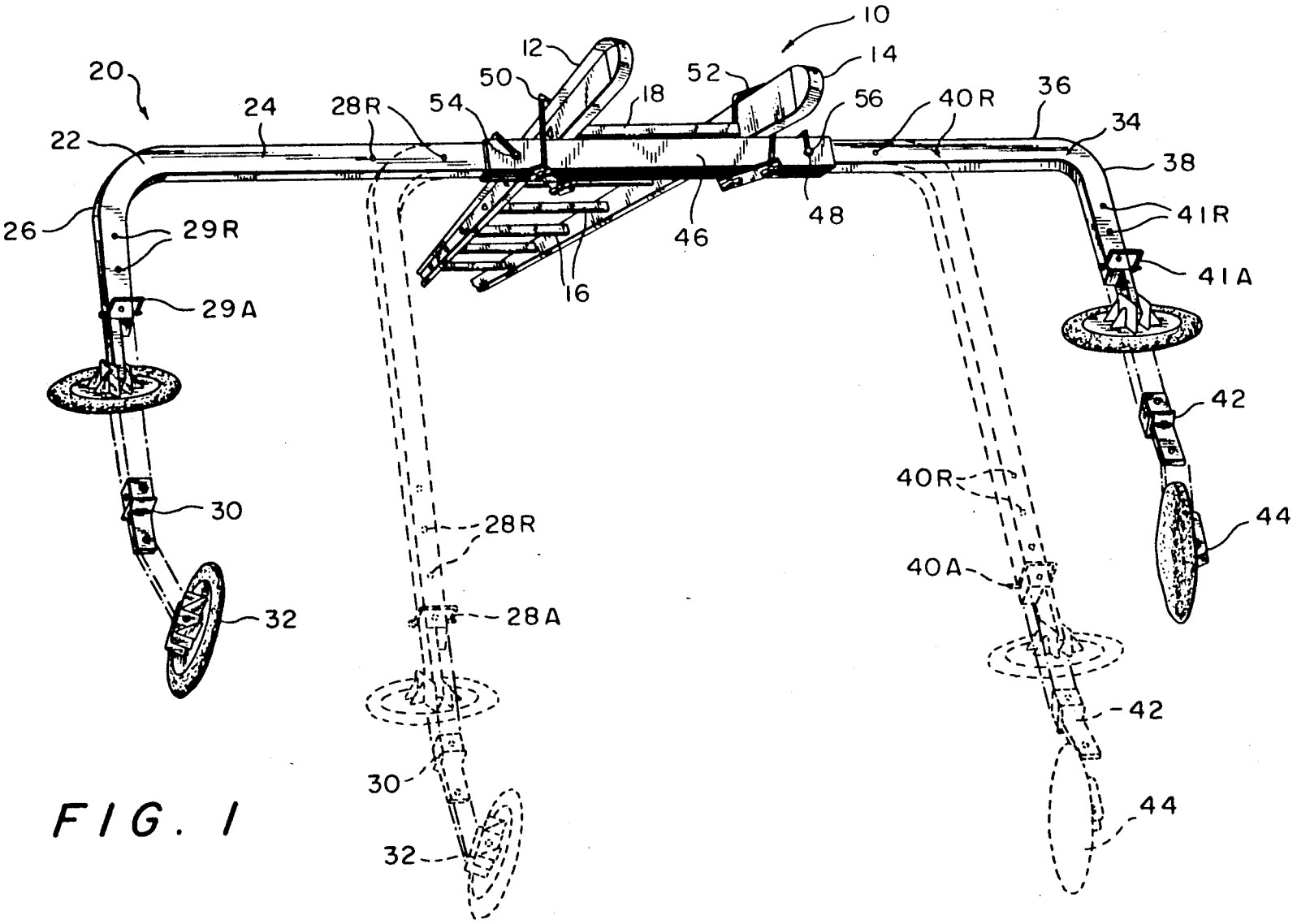
FIG. 1 is an isometric view of a preferred embodiment of a ladder with an adjustable stand-off brace with corner adapters attached in accordance with the present invention, and illustrating the adjustability of the stand-off brace.

Referring to FIG. 1, a ladder 10 has first and second siderails 12, 14, and a plurality of rungs 16, including a top rung 18, extending at spaced intervals between the siderails 12, 14. In the ladder 10, the length of the rungs 16, 18 is fixed and thereby fixes the width of the ladder 10. The width of the ladder 10 typically ranges from about ten to about twenty inches, while the length ranges from about ten to about forty feet or more. Thus, the ladder 10 is very long compared to its width.

A stand-off brace 20 is attached to the ladder 10. The stand-off brace 20 is preferably constructed of hollow aluminum or steel, or other strong, durable material, and conveniently has a round or rectangular cross section. The stand-off brace 20 includes a first member 22 that has a rail portion 24 and an end portion 26 angularly extending from the rail portion 24. The rail portion 24 is preferably longer than the end portion 26. Preferably, the end portion 26 extends from the rail portion 24 at a right angle. The transition from the rail portion 24 to the end portion 26 may be an abrupt angular change, or, more preferably, may be a curved transition. The rail portion 24 may have one or a plurality of rail holes 28R therein and an adapter hole 28A. The end portion 26 may have one or a plurality of rail holes 29R therein and an adapter hole 29A. The end portion 26 preferably includes means, such as a corner adapter 30, for pivotally connecting a resilient pad assembly 32. Such a resilient pad assembly is described in detail in U.S. Pat. No. 4,754,842, which issued to the present inventor on Jul. 5, 1988, and is incorporated herein by reference.

The stand-off brace 20 includes a second member 34 that has a rail portion 36 and an end portion 38 angularly extending from the rail portion 36. The rail portion 36 is preferably longer than the end portion 38. Preferably, the end portion 38 extends from the rail portion 36 at a right angle. The transition from the rail portion 36 to the end portion 38 may be an abrupt angular change, or, more preferably, may be a curved transition. The rail portion 36 may have one or a plurality of rail holes 40R therein, and an adapter hole 40A. The end portion 38 may have one or a plurality of rail holes 41R therein and an adapter hole 41A. The end portion 38 preferably includes means, such as a corner adapter 42, for pivotally connecting a resilient pad assembly 44.

The stand-off brace 20 includes a third member 46 that has a plurality of openings 48. The third member 46 is connected to the siderails 12, 14 of the ladder 10 by attaching means, such as U-bolts 50, 52. Preferably, the third member 46 is attached to the rails 12, 14 by the U-bolts 50, 52 in the vicinity of the top rung 18 of the ladder 10. By this construction, the third member 46 may remain attached to the ladder 10 without interfering with the operation of the ladder 10 in the case of an extension ladder 10 wherein attachments sometimes interfere with extension and retraction.

Still referring to FIG. 1, the first member 22 fits into one end of the third member 46 and is slidably movable therein between a first position at which the resilient pad 32 is spaced a first, preselected maximum distance from the first siderail 12, and a second position at which the resilient pad 32 is spaced a second, preselected minimum distance from the first siderail 12 (shown in phantom in FIG. 1). The first is member 22 is fixed in position relative to the third member 46 by aligning openings 28R and 48, and inserting a bolt or pin 54 therein retained by a spring clip.

Similarly, the second member 34 fits into the other end of the third member 46 and is slidably movable therein between a first position at which the resilient pad 44 is spaced a first, preselected maximum distance from the second siderail 14, and a second position at which the resilient pad 44 is spaced a second, preselected minimum distance from the second siderail 14 (shown in phantom in FIG. 1). The second is member 34 is fixed in position relative to the third member 46 by aligning openings 40R and 48, and inserting a bolt or pin 56 therein retained by a spring clip.

Preferably, the brace 20 is adjusted so that the first resilient pad 32 is spaced from the first siderail 12 the same distance that the second resilient pad 44 is spaced from the second siderail 14. This equal spacing of the pad 32, 44 from the siderails 12, 14 maintains the symmetry of the ladder 10 and, more importantly, improves lateral stability of the ladder 10. The first and second members 22, 34 may be removed from the third member 46 for transport or storage.

In addition, the first and second members 20, 34 may be reversed so that their end portions 26, 38 engage the third member 46 with the rail portions 24, 36 free to receive the corner adapters 30, 42 (shown in phantom in FIG. 1). When reversed, the first member 22 is fixed in position relative to the third member 46 by aligning holes 29R and 48, and inserting retaining pin 54 therein. The second member 34 is fixed in position relative to the third member 46 by aligning holes 41R and 48, and inserting retaining pin 56 therein. By this construction, the ladder 10 will stand farther away from the corner wall when reverse. This construction is also useful when cleaning gutters or working on eaves because the ladder 10 can be firmly supported by the wall of the structure while positioning a worker at a location for easy access to the eaves or gutters.

Figure 2:
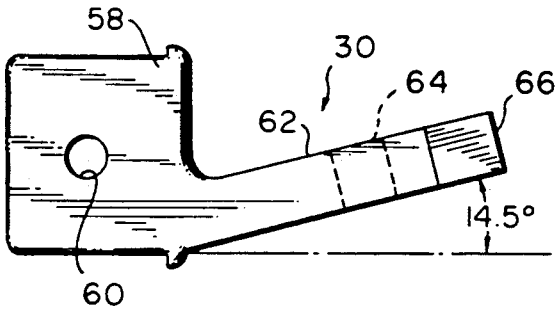
FIG. 2 is a diagrammatic side view of one of the corner adapters of FIG. 1.
Figure 3:
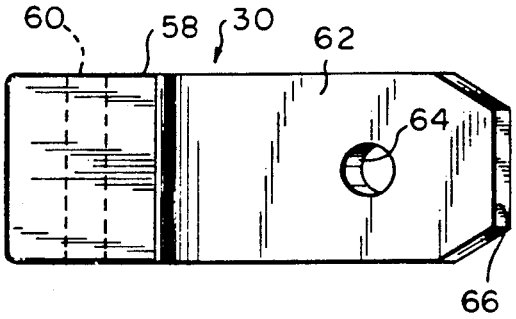
FIG. 3 is a diagrammatic rear view of the corner adapter of FIG. 2.

Referring now to FIGS. 2 and 3 wherein the first corner adapter 30 is illustrated in greater detail. The corner adapter 30 is preferably constructed from a piece of aluminum or other metal. The corner adapter 30 has a body portion 58 with a bore 60 for attaching the adapter 30 to the first member 22. A finger 62 angularly extends from the body 58 at an angle of about 14.5 degrees. The finger 62 has a bore 64 for attaching the resilient pad assembly 32 and preferably has a rounded or chamfered end portion 66. The finger 62 protrudes from the body 58 at the 14.5 degree angle and is lesser height than the body portion 58. The opening 64 in the finger 66 runs perpendicular to the length of the finger 62 and runs generally perpendicular to the opening 60 in the base 58.

The adapter has an overall general "L" configuration with body 58 being the foot of the "L" and the finger 62 being the leg of the "L". The junction of the leg and foot is preferably curved or otherwise relieved, instead of being a square corner, to better accommodate the pivotal motion of the resilient pad assembly 32. Slanting inward toward the foot of the "L" the 14.5 degrees, the leg forms a 75.5 degree angle with the foot. It is preferred that the corner adapter 30 be milled from a solid piece of material forming a plug that fits into the end of the first member 22. Alternatively, the corner adapter 30 may have a partially hollow body 58 that will fit over the first member 22 forming a cap for the first member 22.

Figure 4:
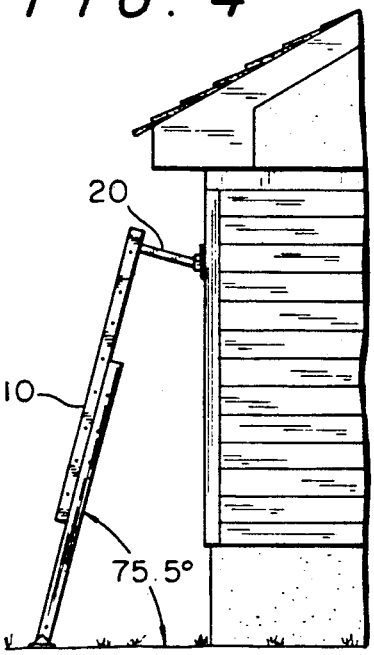
FIG. 4 is a diagrammatic view of a ladder illustrating placement at the recommended angle.
Figure 5:
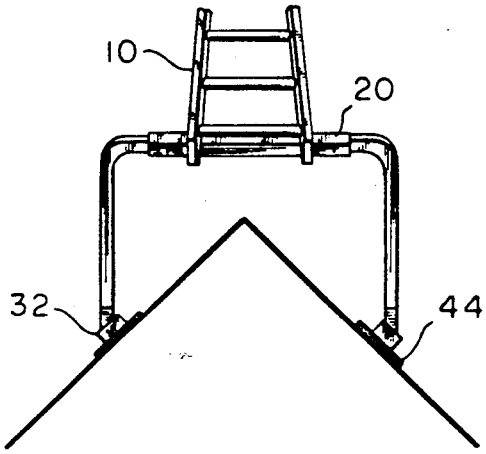
FIG. 5 is a diagrammatic view of a ladder positioned on a corner wall.

Referring now to FIGS. 4 and 5, the ladder 10 is shown in use on a vertical work surface. The ladder 10 is oriented at an angle of 75.5 degrees which is the angle recommended by OSHA. The brace assembly 20 is attached to the ladder 10 at a right angle. Ordinarily, when the ladder 10 is used with the brace 20 resting against the vertical wall, the portion of the brace 20 contacting the wall would contact the wall at an angle instead of perpendicular to it. This causes the resilient pads 32, 44 only making partial contact with the wall instead of full surface contact. This means, as illustrated in FIG. 5, only the top portions of the pads 32,44, the portions coming out of the paper, would contact the wall. To compensate so that the pads 32, 44 are flush, the corner adapters 30, 42 are angled upwardly at 14.5 degrees to make the pads 32, 44 fit flush against the wall when the ladder 10 is at the recommended angle of 75.5 degrees. The pads 32, 44, as illustrated in FIG. 5, pivot to compensate for irregularities in the wall or other work surface, and for fitting comfortably on corner walls. When pivoting, the pads 32, 44 pivot up and down as illustrated in FIG. 5.

Figure 6:
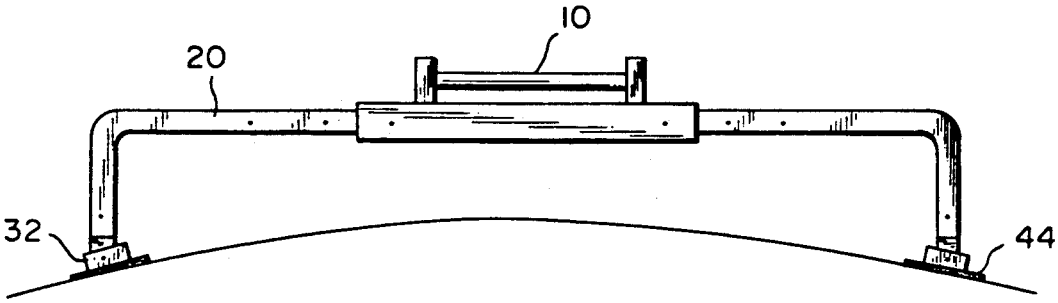
FIG. 6 is a diagrammatic view of a ladder positioned on a curved wall.

Referring now to FIG. 6, the ladder 10 is shown in use on a curved vertical work surface oriented at the recommended angle. The brace assembly 20 is attached to the ladder 10 at a right angle. The pads 32, 44 pivot to compensate for irregularities in and the curvature of the work surface, even curved corner walls. The pads 32, 44 pivot to fit comfortably on water tanks, large pipes, chimneys and other tanks and structures.

While operation of the present invention is believed to be apparent from the foregoing description and drawings, a few words will be added for emphasis. The third member 46 of the brace 20 is attached to the ladder 10 with the U-bolts 50, 52. The pads 32, 44 are attached to the first and second members 22, 34 which are then inserted into the third member 46. The distance between the pads 32, 44 is adjusted by aligning the holes 28R, 48 and 40R, 48, or 29R, 48 and 41R, 48 at the width desired and fixing the position with the pins 54, 56. It is anticipated that the width will be adjusted from time to time which is handy when painting or washing windows.

It will be now appreciated that there has been presented an attachment for a ladder to improve the lateral stability of the ladder. The ladder attachment is adjustable to span various widths of a work surface. The ladder attachment effectively increases the lateral dimension of the ladder to improve lateral stability of the ladder under all conditions. The ladder contacts the work surface with a broad surface area that does not dent, scrape or mar the work surface. A non-slip gripping portion of the ladder attachment engages the work surface without damaging the work surface.

The present invention makes it possible for a ladder to be positioned on a corner wall without the ladder resting on a rung. The present invention provides a ladder which can be positioned on the walls of a corner with the gripping surfaces flash against the walls. Corner adapters connect resilient pad assemblies that pivot to fit flush against corner walls. The corner adapters have angular offsets that keep the ladder at the recommended angle while the pads are flush against the corner walls. When equipped with the corner adapters, a ladder can span windows, doors and fit around corner walls while maintaining the recommended safety angle without damaging the walls.

While the invention has been described with particular reference to a preferred embodiment, it will be understood by those skilled in the art that various changes may be made and equivalents may be substituted for elements of the preferred embodiment without departing from invention. For example, while the corner adapters have been described with reference to the OSHA recommended angle, other angles may be appropriate for special applications. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, the corner adapters may be constructed of a synthetic resin or wood instead of metal. For example, while the adapter holes 29A and 41A have been shown and described as running perpendicular to the rail holes 28R, 29R and 40R, 41R, they can run parallel thereto, or rail holes may be used to attach the adapters 30, 42 when the adapter bore 60 is appropriately positioned generally parallel to the finger opening 64. It is accordingly intended that the claims shall cover all such modifications and applications as do not depart from the true spirit and scope of the invention.

I claim:

1. An apparatus for a ladder having first and second siderails, comprising:

a first member having a first end portion and a second end portion angularly extending from said first end portion, said first end portion being longer than said second end portion;

a second member having a first end portion and a second end portion angularly extending from said first end portion, said first end portion being longer than said second end portion;

a third member extending between said first and second members, said third member engaging one of said first or second end portions of said first member and engaging a corresponding one of said first or second end portions of said second member, said third member engaging said first and second members and being slidably moveable relative thereto to vary the distance between said first and second members;

means for attaching said third member to said siderails;

a first corner adapter releasably attached to the other of said first or second end portions of said first member;

a second corner adapter releasably attached to the other of said first or second end portions of said second member;

a first resilient pad pivotally connected said first corner adapter; and a second resilient pad pivotally connected said second corner adapter.

2. An apparatus, as set forth in claim 1, wherein said first corner adapter forms an end plug fitted in and attached to one of said end portions of said first member.

3. An apparatus, as set forth in claim 1, wherein said first corner adapter has a body attached to one of said end portions of said first member and a finger extending from said body.

4. An apparatus, as set forth in claim 3, wherein said finger angularly extends from said body towards said second member.

5. An apparatus, as set forth in claim 3, wherein said finger extends from said body at an angle of fourteen and one-half degrees.

6. An apparatus, as set forth in claim 3, wherein said first corner adapter has an an L-shaped configuration with said body forming a short base of the L and the finger forming a long leg, said leg and said base forming an angle of seventy-five and one-half degrees.

7. An apparatus, as set forth in claim 3, wherein said first corner adapter has an L-shaped configuration with said body forming a short base of the L having width and depth and the finger forming a long leg having width and depth, said depths being equal and said width of said leg being less than said width of said base.

8. An apparatus, as set forth in claim 3, wherein said finger has a chamfered end portion.

9. An apparatus, as set forth in claim 1, wherein said first corner adapter forms a cap fitted over and attached to one of said end portions of said first member.

10. A ladder, comprising:

first and second siderails connected at spaced intervals by a plurality of rungs;

an elongated bar having first and second end portions and a middle portion attached to said first and second siderails and extending between said end portions, said first and second end portions angularly extending from said middle portion;

a first corner adapter releasably attached to one of said first or second end portions of said elongated bar;

a second corner adapter releasably attached to the other of said first or second end portions of said elongated bar;

a first resilient pad pivotally connected said first corner adapter; and a second resilient pad pivotally connected said second corner adapter.

11. A ladder, as set forth in claim 10, wherein said first corner adapter forms an end plug fitted in and attached to one of said end portions of said elongated bar.

12. A ladder, as set forth in claim 10, wherein said first corner adapter has a body attached to one of said end portions of said elongated bar and a finger extending from said body.

13. A ladder, as set forth in claim 12, wherein said finger angularly extends from said body towards said second end portion.

14. A ladder, as set forth in claim 12, wherein said finger extends from said body at an angle of fourteen and one-half degrees.

15. A ladder, as set forth in claim 12, wherein said first corner adapter has an an L-shaped configuration with said body forming a short base of the L and the finger forming a long leg, said leg and said base forming an angle of seventy-five and one-half degrees.

16. A ladder, as set forth in claim 12, wherein said first corner adapter has an an L-shaped configuration with said body forming a short base of the L having width and depth and the finger forming a long leg having width and depth, said depths being equal and said width of said leg being less than said width of said base.

17. A ladder, as set forth in claim 10, wherein said first corner adapter forms a cap fitted over and attached to one of said end portions of said elongated bar.

18. A ladder, as set forth in claim 10, wherein said finger has a chamfered end portion.

19. An attachment for a ladder, comprising:

an elongated bar having first and second end portions and a middle portion extending between said end portions, said first and second end portions angularly extending from said middle portion;

a first corner adapter releasably attached to one of said first or second end portions of said elongated bar; and a second corner adapter releasably attached to the other of said first or second end portions of said elongated bar, said second corner adapter having a body attached to said second end portion of said elongated bar and a finger extending from said body at an angle of fourteen and one-half degrees towards said first end portion.

* * * * *